US009417030B2

(12) United States Patent
Mathews

(10) Patent No.: US 9,417,030 B2
(45) Date of Patent: Aug. 16, 2016

(54) SAFETY MECHANISM FOR TOY LAUNCHING SYSTEMS

(71) Applicant: Tim Mathews, Atlanta, GA (US)

(72) Inventor: Tim Mathews, Atlanta, GA (US)

(73) Assignee: Westminster, Inc., Atlanta, GA (US)

( * ) Notice: Subject to any disclaimer, the term of this patent is extended or adjusted under 35 U.S.C. 154(b) by 156 days.

(21) Appl. No.: 14/010,999

(22) Filed: Aug. 27, 2013

(65) Prior Publication Data

US 2015/0059727 A1 Mar. 5, 2015

(51) Int. Cl.

| | |
|---|---|
| ***F41B 5/12*** | (2006.01) |
| ***A63H 33/00*** | (2006.01) |
| ***F41B 5/00*** | (2006.01) |
| ***F41B 5/14*** | (2006.01) |
| ***F41B 7/08*** | (2006.01) |

(52) U.S. Cl.

CPC ..... *F41B 5/1403* (2013.01); *F41B 5/12* (2013.01); *F41B 5/1484* (2013.01); *F41B 7/08* (2013.01)

(58) Field of Classification Search

CPC ..... F41B 5/12; F41B 5/143; F41B 7/08; F41B 5/1484

USPC ..... 124/24.1, 25, 21, 22; 473/572, 578, 473/585, 586

See application file for complete search history.

(56) References Cited

U.S. PATENT DOCUMENTS

| | | | | | |
|---|---|---|---|---|---|
| 1,192,639 | A * | 7/1916 | Hunholz | F41B 5/12 | 124/25 |
| 1,375,990 | A * | 4/1921 | Yorgensen | F41B 5/12 | 124/25 |
| 2,370,783 | A * | 3/1945 | Dritz | F41B 5/0031 | 124/24.1 |
| 3,026,864 | A * | 3/1962 | Gray | F41V 7/046 | 124/27 |
| 3,050,046 | A * | 8/1962 | Love | F41B 5/12 | 124/25 |
| 3,388,696 | A * | 6/1968 | Hoverath | F41B 1/00 | 124/41.1 |
| 3,483,857 | A * | 12/1969 | Jones | F41V 5/12 | 124/25 |
| 3,572,311 | A * | 3/1971 | Baer | F41B 3/02 | 124/20.1 |
| 3,581,729 | A * | 6/1971 | Jones | F41B 5/12 | 124/25 |

(Continued)

*Primary Examiner* — Alexander Niconovich

(74) *Attorney, Agent, or Firm* — Bay State IP, LLC

(57) ABSTRACT

A projectile launching system including a safety oriented projectile launching platform and mechanism disposed to segregate the genre of projectile which may be launched from the system. The launching system may include an embodiment embarked upon as a crossbow which includes a control mechanism in combination with which allows only one type of safe projectile to be launched from the device and also either prevents unwarranted or foreign matter from being loaded, or does not allow such items to launch or recoil, thus preventing injury to the users or bystanders.

15 Claims, 5 Drawing Sheets

(56) References Cited

U.S. PATENT DOCUMENTS 3,841,635 A * 10/1974 Wilson ..... F42B 6/003 248/205.5
3,968,783 A * 7/1976 Pfotenhauer ..... F41B 7/006 124/25
4,027,645 A * 6/1977 Damron ..... F41B 5/0005 124/24.1
4,150,508 A * 4/1979 Ogawa ..... A63H 17/00 124/25
4,297,985 A * 11/1981 Rodriguez ..... F42B 6/04 124/22
4,696,281 A * 9/1987 Nishioka ..... F42B 6/00 124/25
4,742,812 A * 5/1988 Goodman ..... F41B 5/12 124/25
4,827,893 A * 5/1989 Nishioka ..... F42B 5/12 124/22
4,917,072 A * 4/1990 Chang ..... F41G 1/467 124/24.1
4,947,822 A * 8/1990 Jones ..... F41B 5/12 124/25
5,062,406 A * 11/1991 Robertson ..... F41B 5/12 124/22
5,247,920 A * 9/1993 Harbin ..... A63F 9/0252 124/17
D349,737 S * 8/1994 Bartling ..... F41B 5/12 D21/571
5,437,260 A * 8/1995 King ..... F41B 5/12 124/25
5,678,528 A * 10/1997 Hadley ..... F41B 5/12 124/24.1
7,748,369 B2 * 7/2010 Chee ..... F41B 3/02 124/20.1
8,012,049 B1 * 9/2011 Walterscheid ..... F42B 6/003 473/572
8,025,596 B2 * 9/2011 Klein ..... F42B 10/08 473/586
8,087,405 B2 * 1/2012 Mitchell ..... F41B 11/646 124/56
8,991,374 B1 * 3/2015 Conkel ..... F41B 5/126 124/23.1
2012/0060807 A1 * 3/2012 Walterscheid ..... F41B 5/12 124/20.3
2012/0160224 A1 * 6/2012 Walterscheid ..... F41B 5/0094 124/20.1
2013/0263838 A1 * 10/2013 Cummings ..... F41B 5/0094 124/20.1
2014/0000577 A1 * 1/2014 Cummings ..... A63F 9/0252 124/20.1
2015/0119174 A1 * 4/2015 Cummings ..... F42B 6/02 473/585

* cited by examiner

SAFETY MECHANISM FOR TOY LAUNCHING SYSTEMS

FIELD OF THE INVENTION

The present invention relates to toys, and more particularly to toy crossbows that introduce safety mechanisms which ensure that users and bystanders are protected.

BACKGROUND OF THE INVENTION

Crossbows have been in existence for sport and hunting for centuries. Toy crossbows for children have existed for centuries and more modern renditions using updated materials such as polymers have existed over one hundred years, but without safety limitations these toys can become dangerous and children or others could be hurt. Crossbows and other projectile launchers, even if they come with safe projectiles, have been used to launch other, non-safe, projectiles such as rocks, pencils or sharp objects.

Clearly, when it comes to children's toys, safety is the most important thing. In order to ensure the safety of children and those around them, toys designed to launch projectiles, herein crossbows, require numerous safety measures to ensure that the toys are not used with dangerous projectiles, which were not originally envisioned for usage. One safety measure involves manufacturing the toy crossbow with a system wherein only specifically designed "safe" projectiles may be utilized during operation. Such a convention could ensure that children cannot put unintended objects in the crossbow, such as rocks, pencils, or sharp objects.

Thus, limiting the possible projectiles compatible with the crossbow prevents children from hurting themselves or others around them.

SUMMARY OF THE INVENTION

The instant apparatus and system, as illustrated herein, is clearly not anticipated, rendered obvious, or even present in any of the prior art mechanisms, either alone or in any combination thereof. The versatile system includes methods and a series of apparatuses for creating and utilizing a safety driven projectile launching system, and particularly a crossbow type system. Thus the several embodiments of the instant apparatus are illustrated herein.

Therefore, it is an object of the instant system to introduce a toy crossbow designed to launch only specifically matched safe projectiles, in order to protect the user and others in the vicinity of the crossbow.

It is a further object of the instant system to introduce utilization of a safety screen with a narrow slot specifically shaped to accommodate the matched projectiles and through which the projectiles are inserted.

It is a further object of the instant system to locate this safety screen along a projectile guideway so it is beyond the forward travel of the projectile propulsion mechanism.

It is a further object of the instant system to introduce a means of arresting the forward travel of the projectile propulsion mechanism so that it will not contact any object in the projectile guideway that is beyond the safety screen.

It is a further object of the instant system to introduce channels or guides that keep the projectile propulsion mechanism a fixed distance above the projectile guideway such that the projectile propulsion mechanism will not contact unintended objects of a size small enough to pass through or beneath the safety screen and into the projectile guideway area that is behind the safety screen.

It is a further object of the instant system to introduce a shield mechanism at the rear of the launcher that will protect the user from launching mishaps.

It is a further object of the instant system to have this rear shield mechanism shaped on the underside so as to keep the intended safe projectiles aligned with the specially shaped slot of the safety screen as the projectile is inserted or launched.

It is a further object of the instant system to have a sight incorporated into this rear shield and guide mechanism so as to aid the user in aiming the device prior to launching a projectile.

It is a further object of the instant system to have a safe projectile that has a suction cup at the front end.

It is further object of the instant system to have a safe projectile that has a four fin tail that is inserted through the safety screen control slot.

It is a further object of the instant system that a string is attached to the right and left horizontal bow arms.

It is a further object of the instant system that the string is to be pulled back so that is held taught and resting behind the notch ready for release.

It is a further object of the instant system that when the trigger is pulled, the string is released, and the safe projectile is launched down the projectile guideway of the crossbow.

It is a further object of the instant system to introduce utilization of a safety screen with an X-shaped slot through which the projectiles are inserted.

In this respect, it is to be understood that the system is not limited in its application to the details of construction and to the arrangements of the components set forth in the following description or illustrated in the drawings. The system is capable of other embodiments and of being practiced and carried out in various ways. Also, it is to be understood that the phraseology and terminology employed herein are for the purpose of description and should not be regarded as limiting.

These together with other objects of the instant system and accompanying apparatuses, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE INVENTION

The detailed description set forth below is intended as a description of presently preferred embodiments of the invention and does not represent the only forms in which the present invention may be construed and/or utilized. The description sets forth the functions and the sequence of the steps for producing the system and accompanying apparatus. However, it is to be understood that the same or equivalent functions and sequences may be accomplished by different embodiments also intended to be encompassed within the scope of the invention.

Figure 1:
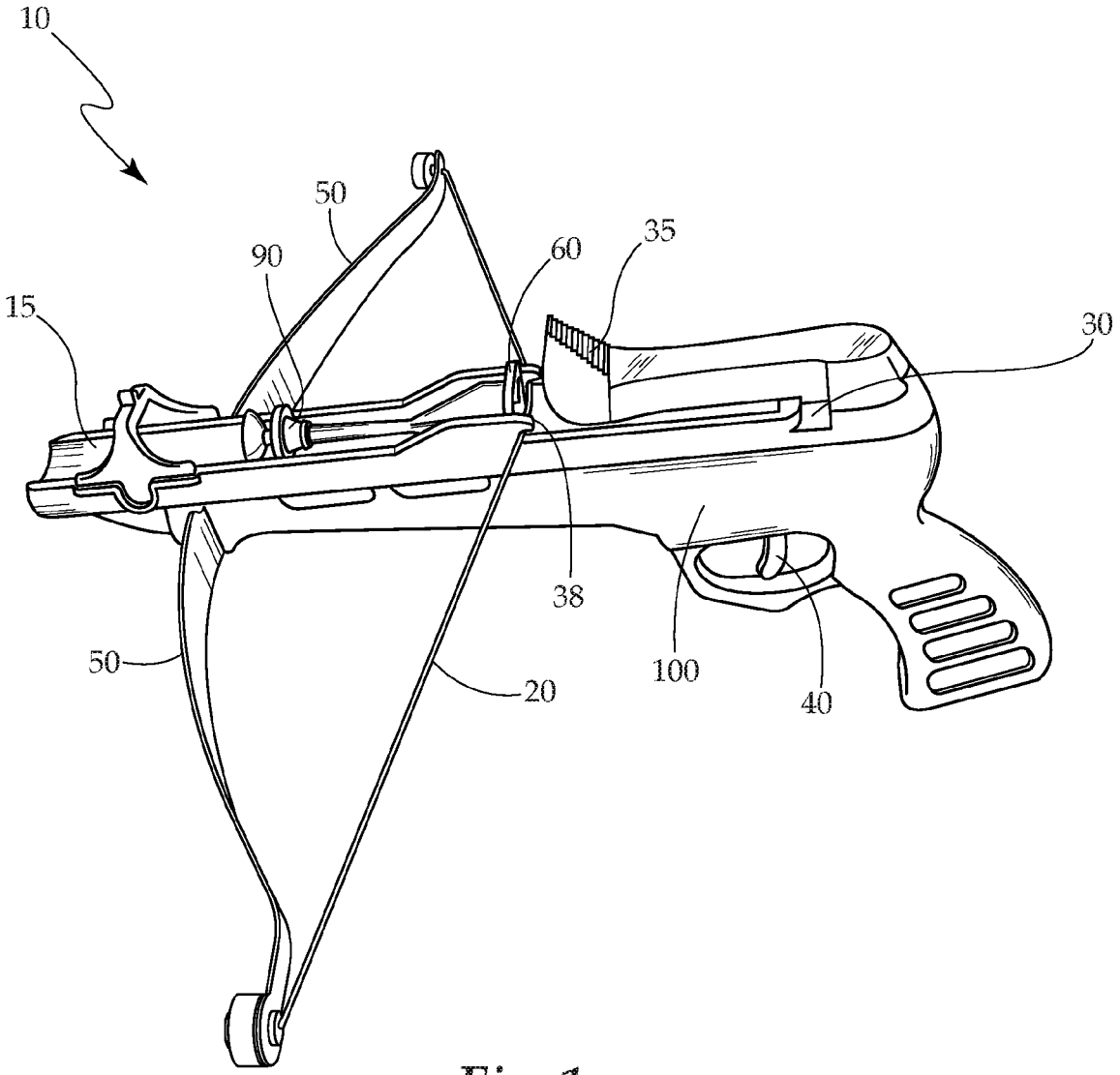
FIG. 1 is a side perspective view of the instant system embarked in a crossbow and further illustrating the safe projectile juxtaposition to, but not yet engaged with, the control slot of the safety screen mechanism.
Figure 2:
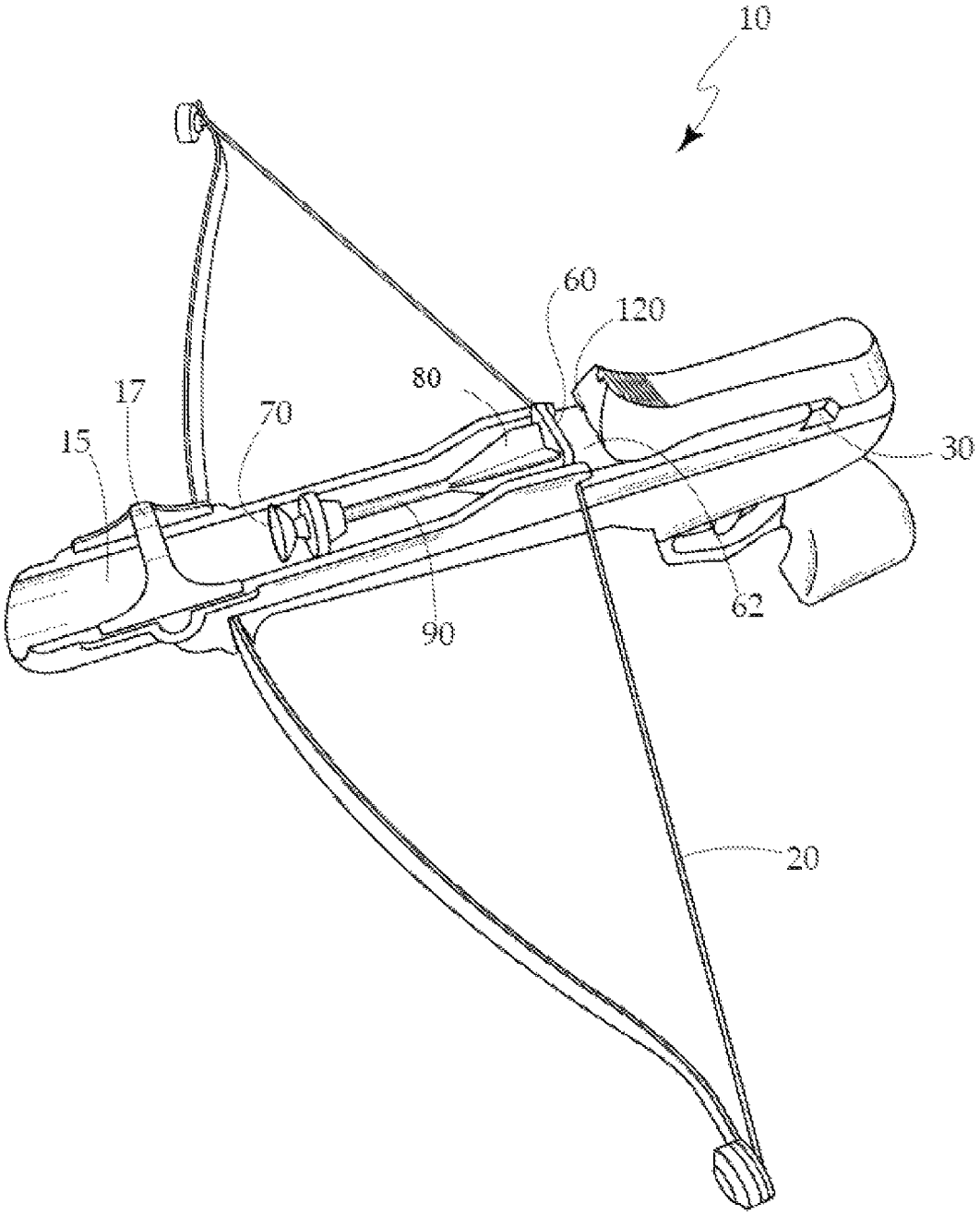
FIG. 2 is a top perspective view of the instant system and further illustrating the safe projectile juxtaposition to, but not yet engaged with, the control slot of the safety screen mechanism.
Figure 3:
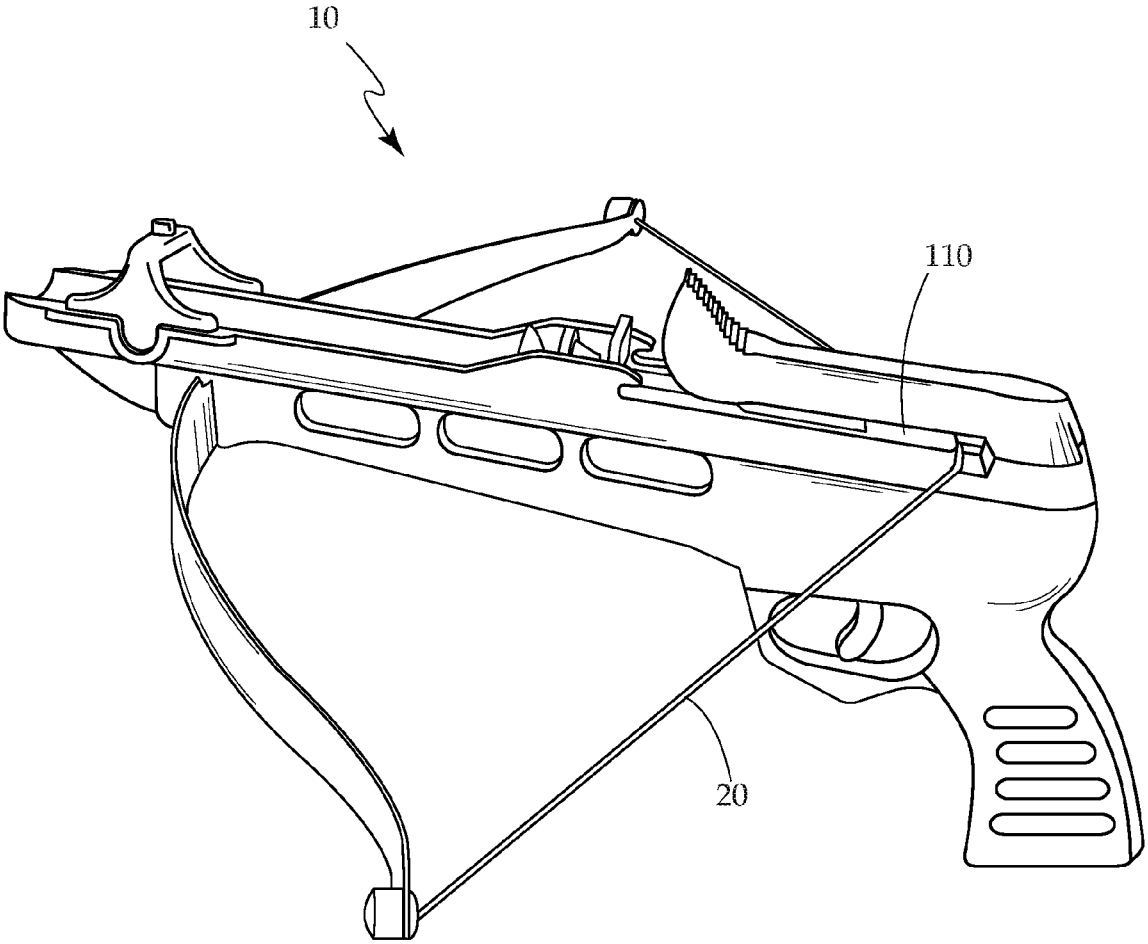
FIG. 3 is a side view of the instant system illustrating the projectile in the launch position and wherein the projectile propulsion apparatus is held taught by the launching notch and the trigger ready for launching a projectile.
Figure 4:
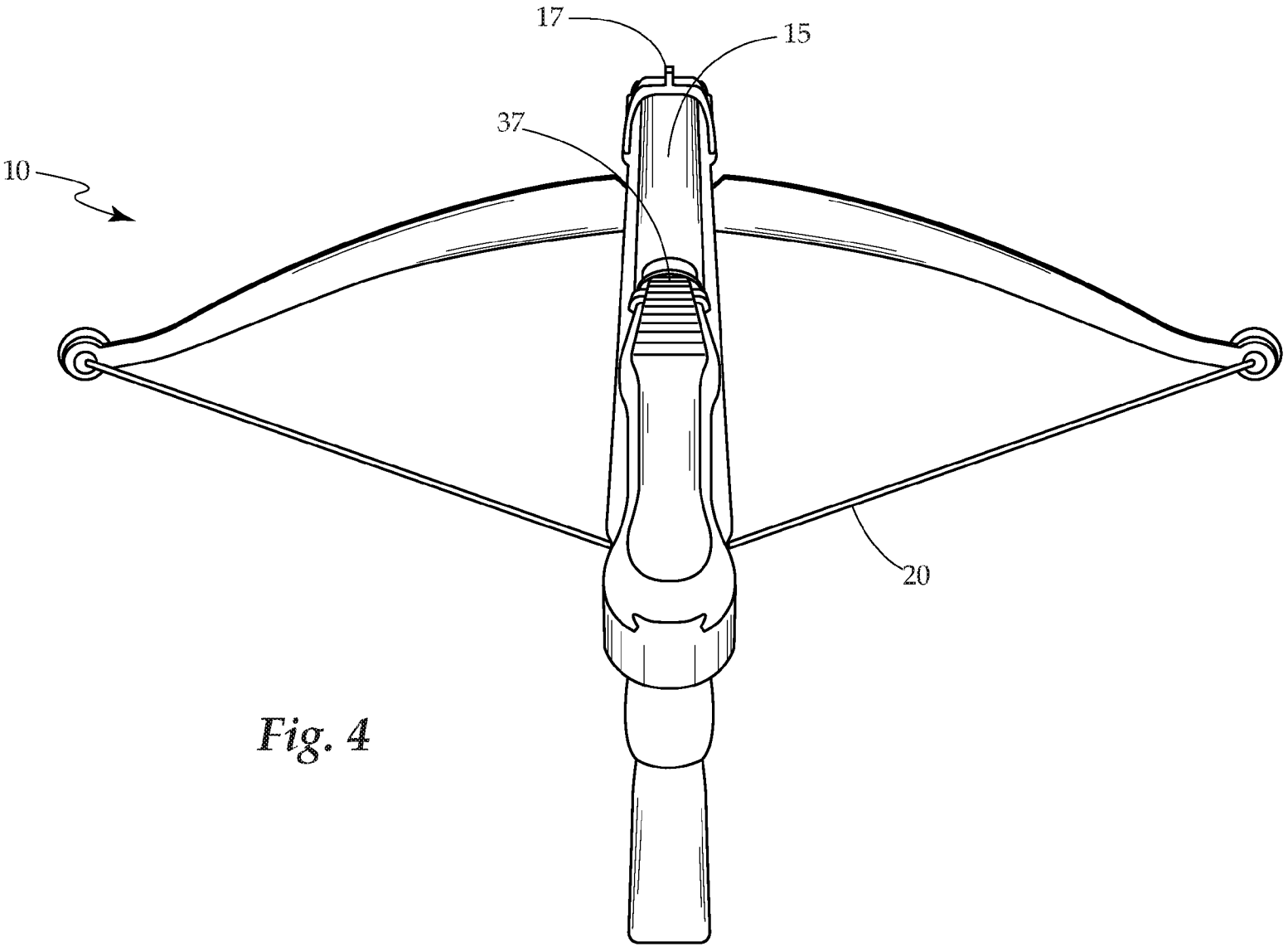
FIG. 4 is a top view of the instant system looking from the rear illustrating the projectile in the launch position and wherein the projectile propulsion apparatus is held by the launching notch and the trigger ready for launching a projectile.
Figure 5:
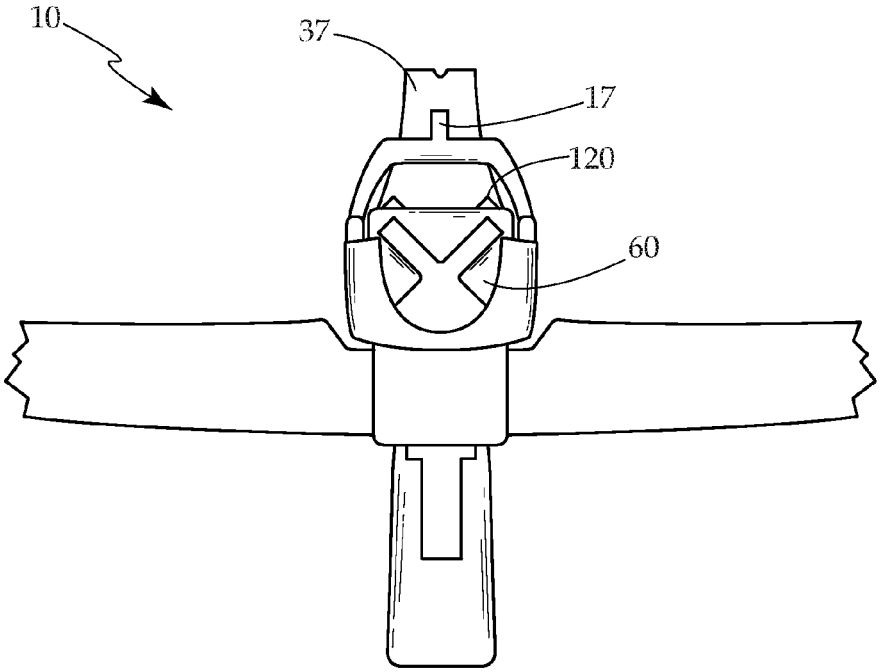
FIG. 5 is a front view of the instant system illustrating the safety screen control slot mechanism or launching slot mechanism without a projectile.
Figure 6A:
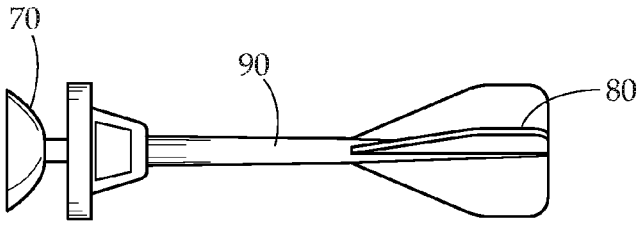
FIG. 6A is a side view of the safe projectile.
Figure 6B:
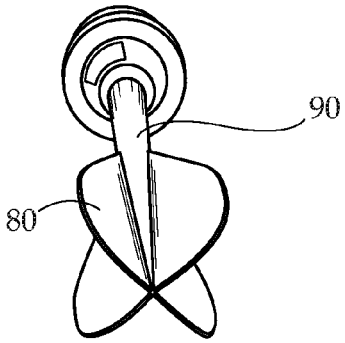
FIG. 6B is a rear view of one embodiment of the safe projectile featuring a four fin tail that is inserted through the safety screen control slot.

FIGS. 1-6B depict various views of the present system and apparatus, and the accompanying components. In one embodiment, the present system comprises a projectile launching system 10, such as a toy crossbow 10, comprising a launching platform 100 that is designed to receive and launch only specifically designed safe projectiles 90.

In one embodiment, the instant apparatus may comprise a bow and string launching mechanism 20, in one embodiment a string 20 that when manually pulled tight and then released by the trigger 40, it launches the inserted projectile 90. When the projectile propulsion apparatus or string-like mechanism 20 is pulled taught the string-like mechanism 20 is placed in the launching apparatus retaining notch 30. Therein, the string-like mechanism 20 rests until released by the trigger 40 whereupon the string-like mechanism 20 launches the projectile 90 forward.

Also illustrated is the launching chamber shield/alignment device 35, which both guides the intended safe projectile and prevents the projectile or foreign matter from backfiring on the user.

In an additional embodiment, a sighting sight system 17 may be introduced. This system may work in coordination with a sighting aperture 37, placed on the upper portion of the launching chamber shield/alignment device 35, in order to allow the user to accurately aim the cross bow 10.

In one embodiment, the crossbow 10 may comprise two horizontal bow arms 50, a left bow arm and a right bow arm, and wherein a launching mechanism 20, in one embodiment, a string 20, may be affixed to each side of the bow arms 50. The bow arms may comprise a flexible polymer or metallic material, a composite or any combination thereof, including coated materials.

The crossbow 10 may be equipped with a projectile guideway 15 wherein the projectile guideway 15 may be substantially cylindrical in nature. The projectile guideway 15 may include a safety screen with control slot mechanism 60, disposed to receive and retain the projectile 90 upon inserted. The safety screen with control slot mechanism 60 divides the projectile guideway and thus defines a launching chamber 62 wherein the launching mechanism physically meets the projectile 90 and upon release of the trigger 40, exerts the force which propels the projectile 90.

The safety screen with control slot mechanism 60 may be so disposed as to receive, and allow launching of, only of specifically designed projectile. In one embodiment, the safety receiving and retaining channel or the safety screen with control slot mechanism 60 may be X-shaped and placed in the rearward portion of the projectile guideway 15 but forward of the pair of launching apparatus arresting notches 38.

Moreover, the safety screen with control slot mechanism 60 is also deemed a fail-safe mechanism 60 as in the instant wherein a user, particularly a child, places an unwarranted object into the launching chamber 62, the fail-safe mechanism 60 will not allow for the object to be launched as the object will either be deflected back and retained within the launching chamber 62, or the launching mechanism 20 will pass above the object without making contact.

In an exemplary model, the control slot mechanism 60 may be disposed to possess an X-shaped, a star shaped or any shape slot or channel that will readily allow for the restriction of objects not specifically designed to fit into the projectile guideway 15. Thus, the X-shaped launching slot 60 is designed in such a shape so that only the intended safe projectiles 90 can be launched from the crossbow 10. Thus, due to the usage of the safety screen with control slot mechanism 60 in conjunction with the raised projectile contact area of the launching mechanism 20, inappropriate objects cannot be launched from the crossbow 10.

Furthermore, in yet another embodiment, the launching chamber shield/alignment device 35 contains a pair of groove slots 120, wherein the pair of groove slots 120 align with the projectile 90 in order to secure the projectile 90 in the launching chamber 62 prior to launch. Additionally, a launching mechanism guideway 110 within the launching chamber 62 enables for a configuration of the launching chamber 62 such that the launching mechanism 20 is guided at a fixed distance above the lowest portion of the launching chamber 62.

FIGS. 5A and 5B depict various viewpoints of the safe projectile 90. The tip of the projectile 90 may comprise a rubber suction adhesion cup 70, or other impact absorbing material. In all embodiments, the outer surface of the tail portion, or finned tail portion 80, of the projectile will be constructed to substantially follow the corresponding contours and shape of the opening of the control slot of the safety screen mechanism 60.

For exemplary purposes, the finned tail portion 80 of the projectile 90 may comprise a substantially X-shape so that it can be inserted through the X-shaped safety screen control slot 60. In additional embodiments, such apparatuses as safety enhanced sling shots, wrist rockets or even catapults are envisioned. The above introduced safety receiving and retaining channel, or control launching slot mechanism 60 can be adapted to many projectile launching mechanisms in order to allow access to the launching area solely by intended matched projectiles.

To further exemplify the individual apparatuses and embodiments, the system is disposed to launch a projectile, in one embodiment would comprises left and right bow arm, of polymeric, metallic, composite, compound metallic-polymeric construction, with a tensioned launching mechanism, made of either string, a polymeric band, or a tension band, attached to the outer ends of both bow arms. Thus, when the chosen material is used in conjunction with the flexibility of the bow arms, the launching mechanism encompasses the launching cavity and engages the launching notch. An alternative projectile propulsion mechanism utilizing a compressed spring, torsion device, or an elastic cord configured so as to move above, and thereby not engage, unintended objects small enough to pass under the safety screen and thus be placed in the launch chamber is also envisioned.

The system may include a launching notch and projectile guideway wherein a safety screen with a receiving slot in the shape of an X, star, polyhedral or other possible configuration is positioned toward the rear of the projectile guideway, in proximity to the launching notch itself. The receiving station has a profile that is the same size and shape as the tail section of the projectile that fits tightly into it.

A projectile, which is cone shaped with the end section being tapered and smaller than the frontal portion and has a rubber suction cup at its front and a four fin tail section at its rear that fits tightly into the receiving station, is placed through the safety screen and tightly fitted into the receiving station. To loose, release or launch the projectile, a trigger mechanism, which is part to the launching system, may be utilized.

The child-safe toy crossbow system that, in one embodiment, includes a flexible left and right bow arm, flexible launching mechanism, a control slot of non-uniform aperture shaped like an X, a shield/alignment device over the launching chamber, a launching notch, and trigger mechanism that all work together to shoot a projectile that has an identical rear section in both size and shape of the X-shaped non-uniform aperture.

The method providing for a child safe launching mechanism involves, utilizing the totality of the embodiments of the launching mechanism which has flexible bow arms, a launching chamber and chamber shield/alignment device, failsafe mechanism with a X-shaped non-uniform aperture, a launch notch, and trigger mechanism, in conjunction with a projectile, which has its rear outer end being the same shape and size of the non-uniform aperture of the control mechanism, and inserting it through the non-uniform aperture of the control mechanism into the launching notch, and discharging the trigger mechanism.

There has thus been outlined, rather broadly, the more important features of the safe toy crossbow in order that the detailed description thereof that follows may be better understood, and in order that the present contribution to the art may be better appreciated. There are additional features of the system that will be described hereinafter and which will form the subject matter of the claims appended hereto.

In this respect, before explaining at least one embodiment of the system in detail, it is to be understood that the system is not limited in its application to the details of construction and to the arrangements of the components set forth in the following description or illustrated in the drawings. The system is capable of other embodiments and of being practiced and carried out in various ways. Also, it is to be understood that the phraseology and terminology employed herein are for the purpose of description and should not be regarded as limiting.

These together with other objects of the system, along with the various features of novelty, which characterize the system, are pointed out with particularity in the claims annexed to and forming a part of this disclosure. For a better understanding of the system, its operating advantages and the specific objects attained by its uses, reference should be made to the accompanying drawings and descriptive matter in which there are illustrated preferred embodiments of the system.

What is claimed is:

1. A projectile launching system comprising:

a launching platform comprising:

a left bow arm and a right bow arm;

a tensioned launching mechanism;

a trigger mechanism;

a launching notch;

a launching chamber;

a pair of arresting notches;

a safety screen with a slot comprising a shaped receiving area disposed to receive a projectile;

a launching mechanism guideway located within the launching chamber, such that the tensioned launching mechanism is guided at a fixed distance above a lowest portion of the launching chamber;

a projectile comprising:

a proximal and a distal end, wherein the distal end comprises a tail portion disposed to fit tightly within the shaped receiving area, and the proximal end comprises a suction cup tip; and, a launching chamber shield/alignment device comprising:

a pair of groove slots, wherein the pair of groove slots are disposed to align with the projectile to secure the projectile in the launching chamber.

2. The projectile launching system of claim 1 wherein the tensioned launching mechanism is selected from the group consisting of a string, a polymeric band, a tension band.

3. The projectile launching system of claim 1 wherein the shape of the safety screen slot is selected from the group consisting of X-shaped, star shaped, and polyhedral shaped.

4. The projectile launching system of claim 1 wherein the left bow arm and the right bow arm comprise a material selected from the group consisting of polymeric, metallic, composite, compound metallic-polymeric.

5. The projectile launching system of claim 1 wherein the slot comprises an X-shaped profile and a largest area of the distal end of the projectile comprises a correspondingly sized X-shaped profile of corresponding size with the x-shaped profile of the slot.

6. The projectile launching system of claim 1 wherein the projectile is tapered substantially conically from larger at the distal end to smaller at the proximal end.

7. The projectile launching system of claim 1 wherein a proximal end of the tip of the projectile comprises a suction adhesion mechanism.

8. The projectile launching system projectile launching system of claim 1 of wherein the tensioned launching mechanism is attached to the left bow arm and the right bow arm and wherein the tensioned launching mechanism comprises a material that in combination with flexibility of the left bow arm and the right bow arm reflectively encompass the entire launching chamber and engage the launching notch.

9. The projectile launching system of claim 1 wherein the safety screen is located at a front of the launching chamber.

10. The projectile launching system of claim 1 further comprising a sighting system and a sighting aperture located on an upper portion of the launching chamber shield/alignment device.

11. A toy cross bow system comprising:

a launching mechanism comprising a flexible left bow arm and a flexible right bow arm;

a flexible launching mechanism;

a projectile guideway mechanism;

a safety screen with a control slot comprising a non-uniform aperture;

a device to arrest forward motion of the launching mechanism;

a launching mechanism guide that is sufficiently elevated above the projectile guideway mechanism so as to not engage small objects;

a launching chamber shield/alignment device;

a launching notch mechanism;

a trigger mechanism; and said launching chamber shield/alignment device comprising:

a pair of groove slots, wherein the pair of groove slots are disposed to align with a projectile to secure the projectile in a launching chamber;

wherein the safety screen is placed in a rearward portion of the projectile guideway mechanism but forward of the launching notch mechanism.

12. The toy cross bow system of claim 11 further comprising:

a projectile comprising a rear portion wherein the rear portion comprises an outer area of identical size and shape to that of the non-uniform aperture.

13. The toy cross bow system of claim 12 further wherein the outer area of the rear portion of the projectile is X-shaped.

14. The toy cross bow system of claim 11 further wherein the non-uniform aperture is X-shaped.

15. The toy cross bow system of claim 11 further comprising a sighting system and a sighting aperture located on an upper portion of the launching chamber shield/alignment device.

* * * * *